United States Patent [19]

Yamada

[11] Patent Number: 5,058,473

[45] Date of Patent: Oct. 22, 1991

[54] VENEER CLIPPER

[75] Inventor: Yoshiaki Yamada, Obu, Japan

[73] Assignee: Meinan Machinery Works, Inc., Obu, Japan

[21] Appl. No.: 558,570

[22] Filed: Jul. 27, 1990

[30] Foreign Application Priority Data

Aug. 11, 1989 [JP] Japan ..... 1-209132

[51] Int. Cl.[5] ..... B26D 5/38

[52] U.S. Cl. ..... 83/371; 83/372; 83/436; 83/611

[58] Field of Search ..... 83/611, 596, 56, 341, 83/349, 636, 371, 610, 436, 659, 372

[56] References Cited

U.S. PATENT DOCUMENTS

| | | | |
|---|---|---|---|
| 3,956,954 | 5/1976 | Edwards | 83/341 X |
| 4,008,639 | 2/1977 | Hasegawa | 83/371 |
| 4,244,251 | 1/1981 | Iwao et al. | 83/349 |
| 4,648,299 | 3/1987 | Siegfried | 83/611 X |

FOREIGN PATENT DOCUMENTS 62-9402 2/1987 Japan .

*Primary Examiner*—Douglas D. Watts

*Assistant Examiner*—Kenneth E. Peterson

*Attorney, Agent, or Firm*—Brooks Haidt Haffner & Delahunty

[57] ABSTRACT

A veneer clipper is adapted to make successive cuts continuously while a veneer sheet is being moved forward through a nip formed by a pair of constantly rotating anvil rolls disposed with their axes extending in parallel to each other across the direction in which the veneer sheet is fed. The clipper includes a pair of knife blades disposed on the downstream side of the nip, having cutting edges thereof presented along the nip, and adapted to pivot together in alternate directions between two extreme positions where the cutting edges are placed in engagement with the peripheries of the respective anvil rolls. The cutting edges of the knife blades are of substantially the same length and extend obliquely at an angle with respect to an imaginary line parallel to the axes of the anvil rolls. Each of the cutting edges is turnable about an axis of its associated knife blade extending in parallel to the edge, whereby cutting into the veneer sheet by the cutting edge takes place progressively from one end of the edge toward the other end thereof.

9 Claims, 4 Drawing Sheets

C
V
18
19
23
20
17
12b
13
A
11
14
1
21
10a
10b
10
7
8
6
9
5
3
4
2

VENEER CLIPPER

FIELD OF THE INVENTION

The present invention relates generally to a veneer clipper of the type which is adapted cut a veneer sheet while it is being advanced through the clipper without being stopped temporarily when a cut is made. More specifically, it relates to an improved clipper knife arrangement in a veneer clipper of the above type.

BACKGROUND OF THE INVENTION

Veneer clippers of various types have been proposed which are adapted to cut successively sheets of wood veneer for producing sized veneer sheets each having a predetermined length and width and also for eliminating defective portions of each incoming veneer sheet such as irregularly-shaped leading and trailing edges, cracks, splits and other open defects to yield usable veneer sheets each having a rectangular shape. A veneer clipper which is designed specifically to make successive cuts continuously while a veneer sheet is being moved without a stop through the clipper is disclosed by U.S. Pat. No. 4,008,639 which is assigned to the same assignee as the present invention.

This clipper includes a pair of rotatable anvil rolls disposed one above the other with their axes extending in parallel to each other and positioned to provide a nip therebetween, a feeding conveyer for advancing a veneer sheet toward the nip, and a clipper knife having a straight cutting edge and carried on a holder positioned downstream of the nip. The knife holder is adapted to pivot alternately in opposite directions about an axis parallel to those of the anvil rolls thereby to cause the knife to cut into veneer sheet each time its holder pivots in either direction. In this veneer clipper, veneer cutting is accomplished by the aid of a force by which the veneer sheet is advanced through the nip and the cutting is effected at a position on the sheet which has been determined by a plurality of veneer thickness detectors arranged on the upstream side of the anvil rolls. This clipper has made possible speedy and efficient clipping operation because the veneer sheet does not have to be stopped temporarily for each cut and trims of defective portions cut off from the sheet can be removed and discharged smoothly from the cutting area, thus contributing greatly to the improvement of clipping operation in a veneer processing line.

In the above veneer clipper having a knife with conventional arrangement wherein its cutting edge extends straight and parallel to the axis of the anvil rolls, the entire length of the knife edge cuts into the veneer sheet simultaneously and, therefore, each roll will receive at the same time all the cutting force required for each cut. The anvil roll thus subjected to the cutting force tends to bend or bow away from the knife which then cuts into the veneer sheet and such bending or bowing of the anvil roll causes an incomplete cut. Though this roll bending can be prevented by making the rolls larger in diameter to provide a rigidity that is great enough to resist the bending, it is difficult to cut a veneer sheet successfully on such rolls due to the fact that the angle formed between the knife and an imaginary tangential line at the point of contact of the knife edge with the periphery of such large-diameter roll becomes too acute for proper cutting. Thus, It is desirable that an anvil roll should be small in diameter to make the above angle as close to right angle as possible, but large enough to resist the bending force created during cutting. It is noted that the above bowing of the anvil rolls takes place more easily as the rolls become longer or when the length along which a veneer sheet is cut becomes greater.

SUMMARY OF THE INVENTION

Accordingly, it is an object of the present invention to provide a veneer clipper having an improved clipper knife arrangement by which force applied to the anvil rolls during cutting is reduced to prevent the anvil rolls from bending.

It is another object of the invention to provide a veneer clipper which can permit successful cutting of veneer sheet on anvil rolls having a relatively large axial length.

The veneer clipper according to the present invention includes a conveyer feeding veneer sheets successively, a pair of rotatable anvil rolls disposed with their axes extending in parallel to each other across the direction in which the veneer sheet is fed. The anvil rolls are so positioned as to provide a nip therebetween through which the veneer sheet is held while it is being advanced by rotation of the anvil rolls.

The clipper further includes knife means disposed on the downstream side of the anvil rolls. The knife means includes at least two knife blades having straight cutting edges and disposed closely to each other so that the cutting edges of the blades form a substantially continuous line of cutting edge presented along the nip between the anvil rolls. The knife blades are adapted to pivot about separate axes together in alternating directions so that the cutting edges of the knife blades are placed in engagement alternately with the peripheries of the respective anvil rolls, whereby the veneer sheet is cut on said anvil rolls by the knife means while it is being advanced through the nip between the anvil rolls. The axes for two adjacent knife blades extend obliquely at such an angle with respect to an imaginary line, which lies in a horizontal plane defined by the veneer sheet and transverse to the direction in which the sheet is advanced, that an obtuse angle is formed between the cutting edges of the two adjacent knife blades, whereby cutting into the veneer sheet by the cutting edge takes place progressively from one end of the cutting edge toward the other end thereof.

According to the preferred embodiment of the invention, the knife means comprises two knife blades and it is so arranged that these blades extend obliquely at such an angle with respect to above imaginary line that the inner end of the cutting edge of each knife blade is positioned closer to an imaginary plane which passes the axes of both of said anvil rolls than the opposite outer end of the cutting edge. By so arranging the clipper knife, cutting into the veneer sheet by the cutting edge of each knife blade takes place from the inner end of the edge toward the outer end thereof. As a result, the force applied to the anvil roll when the edge of the knife blade cuts into the veneer sheet is reduced and the anvil rolls prevented from bending. Additionally, clipping of a veneer sheet having an extended dimension, along which it is to be cut, can be accomplished successfully without causing the anvil rolls to bend away from the knife means.

The above and other objects, features and advantages of the present invention will become apparent to those skilled in the art from the following description of the preferred embodiment of veneer clipper according to the invention, which description is made with reference to the accompanying drawing, wherein:

DETAILED DESCRIPTION OF THE EMBODIMENT

Figure 1:
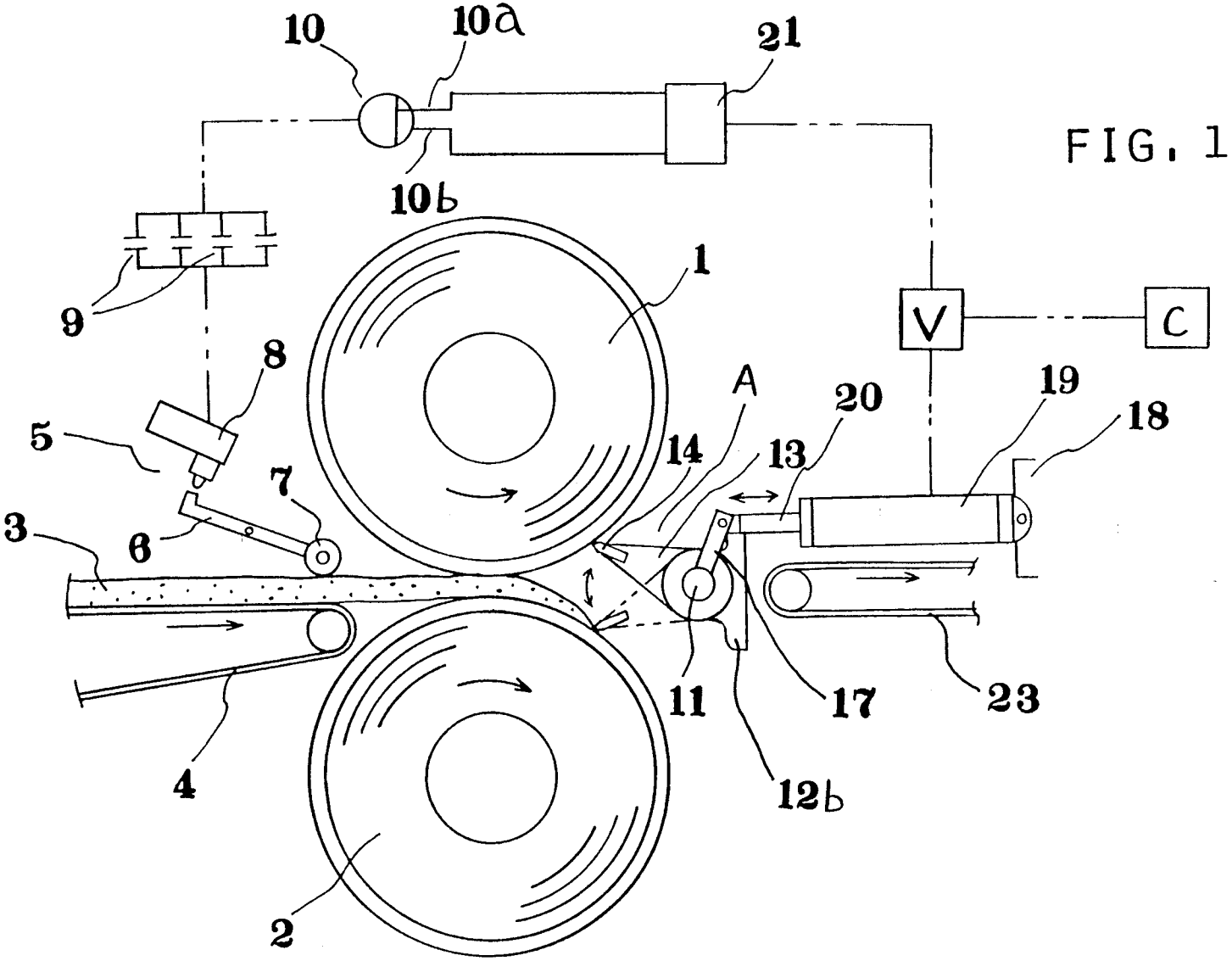
FIG. 1 is a side view showing the preferred embodiment of veneer clipper constructed according to the present invention.

Referring to FIG. 1 showing the preferred embodiment of a veneer clipper according to the present invention, it includes a pair of rolls 1, 2 disposed one above the other with their axes extending in parallel to each other. In operation of the clipper, the rolls 1, 2 are driven constantly to rotate in the direction of the respective arrows. The rolls are spaced from each other so that a clearance is formed therebetween which is slightly smaller than the thickness of a veneer sheet 3 so as to provide a nip for allowing the sheet to advance, or to move rightwards as seen in the drawing, by rotation of the rolls. These rolls 1, 2 serve also as anvil on which the veneer sheet 3 is clipped. For this purpose, they may be clad on their peripheries with resilient material such as rubber.

On the upstream side of the anvil rolls 1, 2 is disposed a conveyer 4 for feeding the veneer sheet 3 toward the nip of the rolls as indicated by an arrow. In the illustrated embodiment, the veneer sheet 3 is placed on the feeding conveyer 4 and conveyed with its lengthwise dimension, or the dimension as measured along the fiber orientation of the wood veneer, presented across the direction in which it is moved toward the nip by the conveyer. The clipper includes a plurality of veneer thickness detectors 5 (only one detector being shown in FIG. 1) located just above the upper run of the conveyer 4 at desired spaced intervals along a line parallel to the axes of the anvil rolls 1, 2. These detectors 5 are adapted to detect the variation in thickness of a veneer sheet passing beneath the individual detectors thereby to locate the positions on the veneer sheet along which it is to be clipped.

Each thickness detector 5 includes an arm 6 pivotable about a pin extending through the center of individual such arms and a detector roll 7 rotatably supported at one end of the arm 6 in such a way that the variation in thickness of a veneer sheet passing therebeneath moves the roll 7 up and down thereby to cause the arm 6 to pivot about the pin. The detector 5 further includes a limit switch 8 positioned so as to be operated by the opposite end of the arm 6 when it is moved into and away from contact with the limit switch 8. In the embodiment shown in FIG. 1, it is so arranged that the full thickness of the veneer sheet 3, or the thickness of an acceptable sound portion of the sheet, is detected when the arm's opposite end is positioned away from contact with the limit switch 8.

Each limit switch 8 has incorporated therein a pair of contact points 9 which are opened when the detector roller 7 rides on a full thickness portion of the veneer sheet and hence the limit switch 8 is released from engagement with the detector arm, as shown in FIG. 1, and closed when the roller 7 is moved down from the full thickness position to cause the detector arm to engage with the limit switch. The contact points 9 of pairs for the individual limit switches 8 are connected in parallel, as shown schematically in FIG. 1, and they are connected to an OR logic circuit 10 which is in turn connected to a control 21. The OR circuit 10 is operable to generate an electrical signal from its NOT OUT terminal 10*a* to the control 21 at the moment when the contact points 9 for all the limit switches 9 become open, i.e. when all the detector rolls 7 are lifted by a full thickness portion of a veneer sheet just moving past the detector rolls. The signal thus produced from NOT OUT terminal 10*a* of the OR circuit 10 represents a position on the veneer sheet where a cut should be made for removal of irregularity at the leading end of the sheet. On the other hand, the OR circuit generates an electrical signal from its OUT terminal 10*b* to the control circuit 21 at the moment when at least any one pair of contact points 9 of a limit switch 8 is closed, i.e. when at least any one of the detector rolls 7 is lowered to bring its detector arm into contact engagement with the limit switch, because of any reduced thickness portion of the veneer sheet just moving past that roll. The signal emitted from NOT OUT terminal 10*a* of the OR circuit 10 represents a position on the veneer sheet along which it should be cut for removal of an irregularity at its trailing end.

Figure 2:
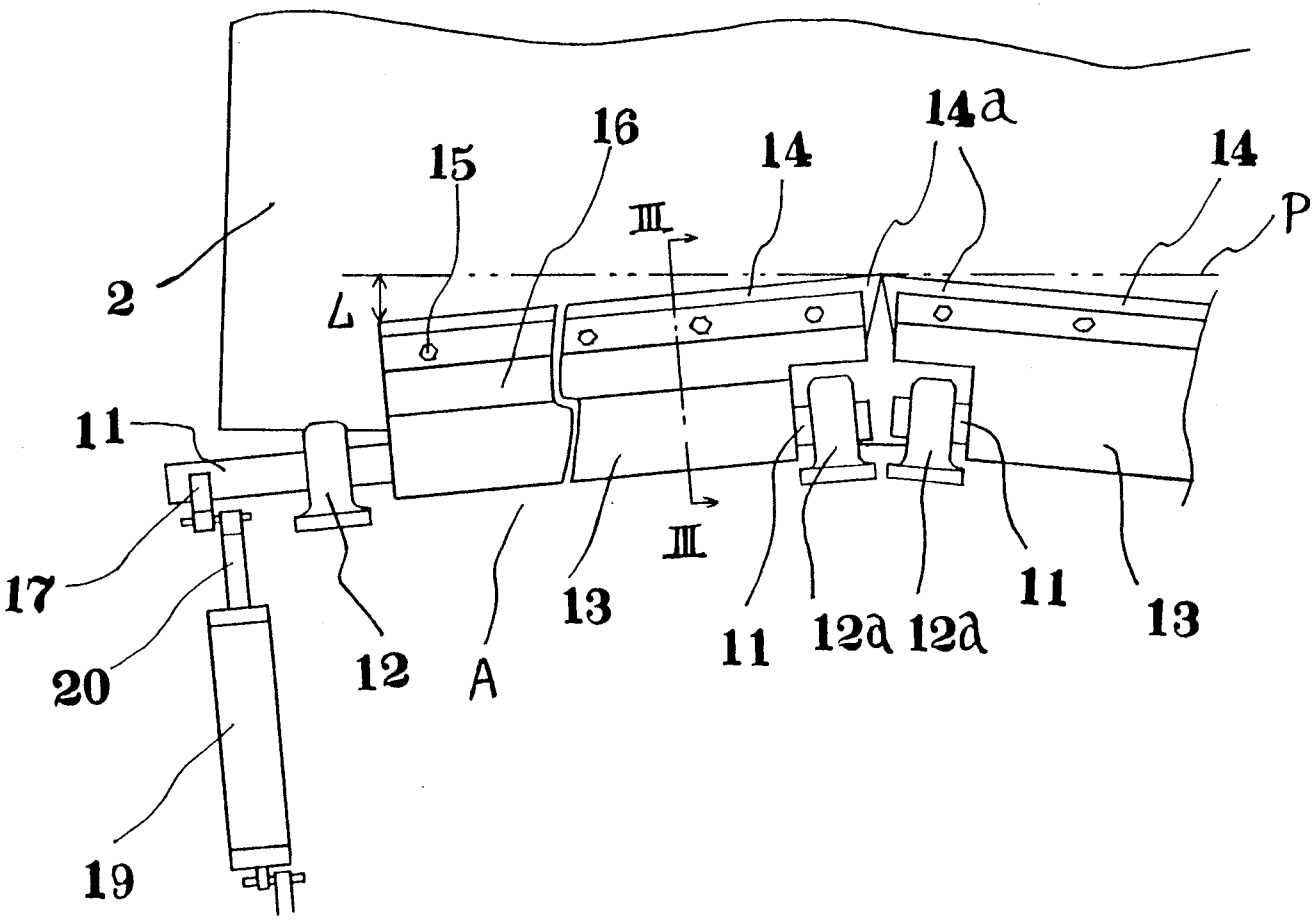
FIG. 2 is a fragmentary plan view showing an arrangement of clipper knife assembly used in the veneer clipper of FIG. 1 and including two knife blades of substantially the same length.

On the opposite downstream side of the anvil rolls 1, 2, there is provided a clipper knife assembly designated generally by reference symbol A. Referring also to FIG. 2, the knife assembly A includes a pair of blades 14 of substantially the same length, each having a straight cutting edge on the side adjacent the nip of the anvil rolls 1, 2 and mounted on a holder 13 fixed on a shaft 11 rotatably supported by a pair of pillow blocks, or bearings 12*a*, 12*b*, which are fixed to the clipper frame (not shown). Each blade holder 13 is pivotable about the shaft 11 in alternate directions between two extreme positions, i.e. solid line position (FIG. 1) where the cutting edge of the blade 14 is pressed against the upper anvil roll 1 and dotted line position where the cutting edge is placed against the lower anvil roll 2. The blade holders 13 are arranged in a row along a line substantially parallel to the axes of the anvil rolls. Incidentially, FIG. 2 shows the clipper knife assembly when the blade holders 13 are pivoted to either of the above two extreme positions.

As shown clearly in FIG. 2, the bearings 12*a*, 12*b* supporting the shafts 11 are arranged with the inner bearings 12*a* positioned slightly closer with respect to the nip of the anvil rolls 1, 2 than the outer bearings 12*b* so that the shafts are positioned obliquely with respect to an imaginary line P which is drawn parallel to the axes of the anvil rolls 1, 2. As a result, the blades 14 are slanted with their cutting edges extending similarly obliquely in a symmetrical way with reference to a line (not shown) passing the tip formed by the contiguous inner ends of the two cutting edges and extending perpendicularly to the phantom line P. It is to be understood that the obliqueness of the cutting edges, indicated by distance L (FIG. 2) between the outer end of cutting edge of each blade and the phantom line P, as measured perpendicularly to the line P, is exaggerated for the sake of understanding of the present invention.

Figure 3:
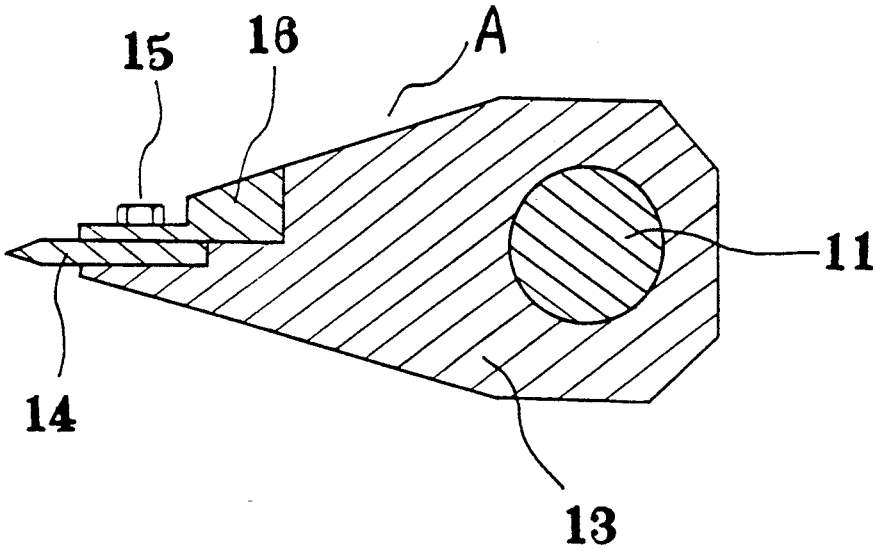
FIG. 3 is a cross-sectional view taken along the line III—III in FIG. 2, showing a knife blade and its holder.

Referring to FIG. 3 showing the knife assembly A in cross section, the knife blade 14 is fixed to its holder 13 by means of a blade clamp 16 and a plurality of screws 15. The knife blade 14 is preferably of a throwaway type which requires no regrinding of the blade but mere replacement thereof with a new one.

In order to provide a substantially continuous line of cutting edge, the blades 14 are set with their cutting edges contiguous with very little gap formed between their inner corner edges 14*a*. when the cutting edges of the blades 14 are in engagement with the peripheral surface of either of the anvil rolls 1, 2. For this purpose, the inner corner portions of the blades 14 are formed with an acute angle preferably with a divergent gap toward the joining point of the contiguous corner edges 14*a*, as shown in FIG. 2, to facilitate the procedure of blade setting. In the embodiment, each blade 14 is set with such obliqueness with respect to the line P that the above distance L is about 2.5 mm for 1,350 mm of blade length. It is noted that the corner edges 14*a* will move away from each other thereby to form a small gap therebetween as the knife blades 14 are pivoted from the cutting position in engagement with the periphery of one anvil roll and that the gap becomes maximum when the blades are moved to the center of their pivotable range which is indicated by the double-headed arrow between the solid-line and dash-line positions in FIG. 1.

As indicated in FIGS. 1 and 2, there is provided a pair of pneumatic cylinders 19 for actuating the knife assembly in alternate directions. Each cylinder 19 has a piston rod 20 operatively connected at its outer end by way of a pin with the distal end of an arm 17 having its proximal end fixed on the outer end of the shaft 11 supporting the blade holder 13. The cylinder 19 is pivotally connected at its opposite end to clipper frame 18. These cylinders 19 include tubes (not shown) connected to a compressor C by way of a solenoid-operated valve V for controlling air flowing into and out of the cylinders to control the cylinder operation.

The aforementioned control 21 adapted to receive a detector signal from the OR circuit 10 is connected to the above solenoid-operated valve V to transmit thereto a control signal in response to reception of the detector signal. Though not shown in the drawing, the control 21 includes a delay control circuit for controlling the time when such control signal is transmitted to the valve so that the cylinders 19 are operated to actuate the knife assembly at a proper time whereby the blades 14 make a cut at the proper position on the veneer sheet 3 detected previously by the thickness detectors 5. This is accomplished by allowing the control 21 to generate a control signal to the solenoid valve with a small time delay after it has received a detector signal from the OR circuit 10. The length of delay time is determined from factors including the time required for the detected position on the veneer sheet to reach a position on either of the anvil rolls 1, 2 where cutting should be effected with minimum loss of usable veneer portion.

A delivery conveyer 23 is disposed on the downstream side of the anvil rolls 1, 2 for transferring a cut veneer sheet toward a subsequent station.

The following will explain the operation of the veneer clipper thus constructed.

In operation of the clipper, the feeding conveyer 4, the anvil rolls 1, 2 and the delivery conveyer 23 are running constantly. Before a veneer sheet is fed into the clipper, the blade holders 13 are both located in their upper position as shown by solid line (FIG. 1) where the blade edges are in engagement with the periphery of the upper anvil roll 1. A veneer sheet 3 is placed on the feeding conveyer 4 and advanced toward the anvil roll nip with its lengthwise dimension, or the dimension as measured along the fiber orientation of the wood veneer sheet, presented across the direction in which the sheet is moved by the conveyer.

When all the detector rolls 7 are lifted, as shown in FIG. 1, by full thickness portion of the advancing veneer sheet 3 thereby to cause the contact points 9 of the limit switches 8 to be opened, the OR circuit 10 generates a detector signal from its NOT OUT terminal 10*a* to the control 21. In response to such signal, the control 21 transmits a control signal to the solenoid valve V at a controlled delayed time to operate the cylinder 19 so that its piston rod 20 is extended. This causes the blade holder 13 to swing down about the shaft 11 to its phantom-line position where the veneer sheet 3 is cut just at the position which has been detected by the thickness detectors 5 and the irregularity at the leading end of the veneer sheet 3 is cut off. Because each of the blades 14 is set obliquely with respect to the axes of the anvil rolls 1, 2 with the inner blade corner edges 14*a* closer to the anvil rolls, the edge of each knife blade 14 cuts into the veneer sheet from the inner end toward the outer end of the cutting edge. As a result, the anvil roll 2 receives cutting pressure firstly from the center thereof and then outwards. Thus, the roll 2 will not be subjected to a force that would otherwise cause it to be bowed away from the clipper knife.

After such cutting, the defective portion cut off from the veneer sheet 3 is guided downwards and discarded, while the remaining portion of the veneer sheet is simultaneously moved through the anvil roll nip and over the blade holders 14 which then serve to support and guide the veneer sheet toward the delivery conveyer 23.

When at least any one of the detector rolls 7 is displaced from its lifted position while the veneer sheet is moving past the same rolls thereby to cause the contact points 9 of its limit switch 8 to be closed, the OR circuit 10 generates a signal from its OUT terminal 10*b* to the control 21. In response to such signal, the control 21 transmits a control signal to the solenoid valve V at a controlled delayed time to operate the cylinder 19 so as to retract its piston rod 20. This causes the blade holder 13 to swing about the shaft 11 back to its solid line position where the veneer sheet 3 is cut just along the detected position. In this cutting for removal of the defective portion on the trailing end of the veneer sheet 3, cutting into the veneer sheet by the cutting edge of each blade 14 takes place from the inner end toward the outer end thereof. Therefore, the anvil roll 1 receives cutting force firstly from the center and then outwards. The defective portion cut off from the trailing end of the veneer sheet 3 is guided downwards and discarded. A veneer sheet thus produced is transferred by the delivery conveyer 23 to the subsequent process and the clipper becomes ready to receive a new veneer sheet.

The above steps of operation are repeated to cut off irregularities on the leading and trailing ends of successively coming veneer sheets without stopping their movement through the clipper.

In order to prevent possible wear of the knife blade edges due to engagement with the peripheries of the rotating anvil rolls 1, 2, operation may be so controlled by the control 21 that the knife blade edges are moved slightly away from engagement with the anvil roll periphery after it has cut through the veneer sheet.

A cut end of a veneer sheet resulting from such clipping will have a shape similar to the oblique arrangement of the knife blade cutting edges. In splicing a plurality of such veneer sheets in an end-to-end manner, for example, for producing a veneer sheet of format size of predetermined length and width dimensions, the cut sheets can be jointed or spliced with no substantial problem. In order to facilitate splicing or to secure a tight joint, however, the ends may be clipped straight afterwards before the splicing.

While the invention has been described and illustrated specifically with reference to the above preferred embodiment, it is to be understood that the invention can be practiced with various changes and modifications without departing from the spirit or scope thereof, as exemplified below.

Figure 4:
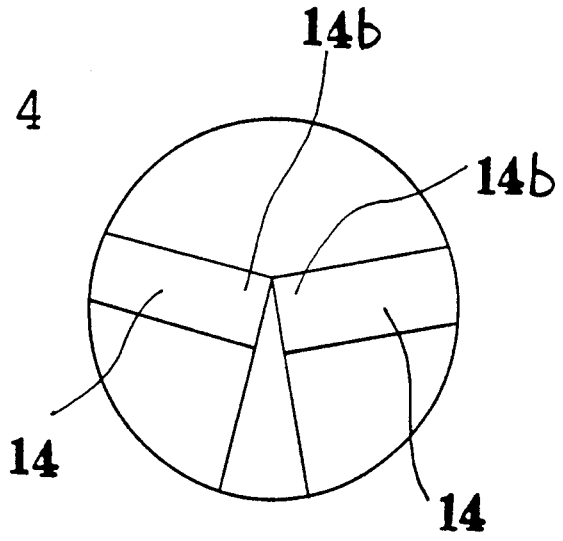
FIG. 4 is a fragmentary plan view showing an alternative arrangement of two blades according to the invention.

Though the blades 14 are set in an oblique arrangement with their inner corner edges 14*a* closer to the anvil rolls 1, 2, they may be set oppositely oblique, as shown in FIG. 4, with the inner corner edges 14*b* 14*b* farther than the outer corner edges with respect to the anvil rolls. In such an arrangement, the blade corner portions 14*b* do not have to be formed with an acute angle as in the preferred embodiment, but they may be square. It is to be noted that FIG. 4 shows the corner edges 14*b* when their knife blades 14 are positioned at the center of their pivotable range and that the edges 14*b* will part from each other thereby to increasingly form a gap therebetween as the blades are pivoted in either direction upward or downward from the center position. Alternatively, the blades 14 may be set and fixed to their holders with a small gap left between the corner edges 14*a*. A gap of about 1 mm will not affect the cutting results.

The above description has been directed to an embodiment of veneer clipper which is designed to cut off the leading and trailing irregularities of a veneer sheet. It would be apparent to those skilled in the art, however, that this invention is applicable also to a clipper which is adapted to cut a continuous ribbon of veneer into sized sheets.

In the above preferred embodiment, the two knife holders 13 pivot integrally about the shafts 11 for cutting veneer sheets which are fed into the clipper successively in a single row. It may be so arranged, however, that the feed conveyer is adapted to receive two rows of halflength veneer sheets, a plurality of thickness detectors, similar to those detectors 5 of FIG. 1, is provided for each of the rows, and each of the knife holders has its own actuating cylinder so as to pivot independently of the other holder so that veneer sheets fed along each row are clipped according to the information from each group of detectors.

Figure 5:
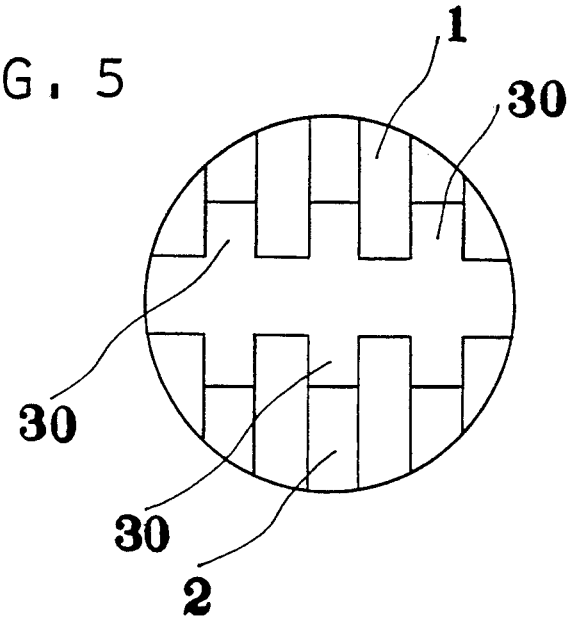
FIG. 5 is a fragmentary view showing a pair of anvil rolls of a modified form, as viewed from the delivery side thereof.

Publication of Examined Japanese Patent Application No. 62-9402 (1987) discloses a veneer clipper provided with anvil rolls each formed on the periphery thereof with a number of grooves 30 equally spaced and extending circumferentially about the roll, as schematically shown in FIG. 5. The clipper knife arrangement according to the present invention may be used advantageously in combination with such circumferentially grooved anvil rolls.

The knife assembly may include more than two blades which are arranged obliquely in alternating directions with respect to the axes of the anvil rolls.

What is claimed is:

1. A clipper for cutting a sheet of wood veneer comprising:

a conveyor for feeding veneer sheets successively in forward direction through the clipper;

a pair of rotatable cylindrical anvil rolls having anvil surfaces on peripheries thereof, disposed with the axes thereof extending in parallel to each other across said forward direction of the veneer sheets, and positioned so as to provide a nip between said anvil rolls through which the veneer sheet is held while said sheet is being advanced by rotation of said anvil rolls;

knife means disposed on a feed-out side of said anvil rolls, including at least two knife blades having straight cutting edges, respectively, disposed so closely to each other that the cutting edges thereof form a substantially continuous line of cutting edge presented along said nip, and adapted to pivot about separate axes together in alternating directions between two extreme positions where the cutting edge of each said knife blade is placed in engagement with the peripheries of the respective anvil rolls, whereby the veneer sheet is cut on said anvil rolls by the knife means while the sheet is being advanced through said nip;

said separate axes for any two adjacent knife blades extending symmetrically obliquely at such an angle with respect to an imaginary line, which lies in a horizontal plane defined by said sheet and transverse to the direction in which said sheet is advanced, that an obtuse angle is formed between the cutting edges of said two adjacent knife blades, whereby cutting into the veneer sheet by the cutting edge takes place progressively from one end of the cutting edge toward the other end thereof.

2. A clipper according to claim 1, wherein said knife means comprises two knife blades of substantially the same length, the cutting edge of one knife blade having an inner end positioned close to a similar inner end of the other knife blade and an outer end remote from a similar outer and of said other knife blade.

3. A clipper according to claim 2, wherein said knife means includes holders holding said knife blades and pivotable about said separate axes.

4. A clipper according to claim 2, wherein said separate axes for said two knife blades extend obliquely with respect to said imaginary line such that said outer end of each said cutting edge is positioned farther than the inner end thereof from an imaginary plane passing the axes of both of said anvil rolls, whereby cutting into the veneer sheet by said cutting edge of each edge section takes place from the inner end of the cutting edge progressively toward the outer end thereof.

5. A clipper according to claim 4, wherein said knife blades are arranged with the inner ends of the cutting edges thereof contiguous to each other when said knife blades are positioned in either of said two extreme positions where the cutting edges are placed in engagement with the peripheries of said anvil rolls.

6. A clipper according to claim 2, wherein said separate axes for said two knife blades extend obliquely with respect to said imaginary line such that said inner end of each said cutting edge is positioned farther than the outer end thereof from an imaginary plane passing the axes of both of said anvil rolls, whereby cutting into the veneer sheet by said cutting edge of each edge section takes place from the outer end of the cutting edge progressively toward the inner end thereof.

7. A clipper according to claim 6, wherein said knife blades are arranged with the inner ends of the cutting edges thereof contiguous to each other when said knife blades are positioned at the center between said two extreme positions.

8. A clipper according to claim 3, further comprising means for actuating said knife holders to pivot together in alternative directions, said actuating means being operable to cause said knife holders to pivot simultaneously.

9. A clipper according to claim 3, wherein each of said knife blades extends obliquely at such an angle that the shortest distance between one end of the edge of said each knife blade and an imaginary line drawn in parallel to the axes of the anvil rolls and passing the other end of the same edge is about 2.5 mm for 1,350 of the edge section length.

* * * * *

UNITED STATES PATENT AND TRADEMARK OFFICE

CERTIFICATE OF CORRECTION

PATENT NO. : 5,058,473

DATED : October 22, 1991

INVENTOR(S) : Y. Yamada et al

It is certified that error appears in the above-identified patent and that said Letters Patent is hereby corrected as shown below:

Col. 4, line 23, after "of" (first occurrence) insert --an--.

Col. 7, line 37, start new paragraph at word "Alternatively";

Col. 8, line 45, "and" should read --end--.

Col. 10, line 1, "alternative" should read --alternating--.

Signed and Sealed this

Sixteenth Day of March, 1993

*Attest:*

STEPHEN G. KUNIN

*Attesting Officer*

*Acting Commissioner of Patents and Trademarks*